US007833108B2

(12) United States Patent
Hosowich

(10) Patent No.: US 7,833,108 B2
(45) Date of Patent: Nov. 16, 2010

(54) TRAINING HEAD FOR GOLF TRAINING PUTTER, AND METHOD OF TRAINING

(76) Inventor: Peter Kim Hosowich, 1694 Mercer St., Windsor, Ontario (CA) N8X 3P7

( * ) Notice: Subject to any disclaimer, the term of this patent is extended or adjusted under 35 U.S.C. 154(b) by 885 days.

(21) Appl. No.: 11/407,460

(22) Filed: Apr. 20, 2006

(65) Prior Publication Data

US 2006/0258472 A1 Nov. 16, 2006

Related U.S. Application Data

(60) Provisional application No. 60/679,303, filed on May 10, 2005.

(51) Int. Cl.
*A63B 69/36* (2006.01)
*A63B 53/04* (2006.01)

(52) U.S. Cl. ..... 473/219; 473/231; 473/251; 473/330; 473/340; 473/409

(58) Field of Classification Search ..... 473/324–350, 473/236, 251–254, 219, 231, 409; D21/736–746, D21/752
See application file for complete search history.

(56) References Cited

U.S. PATENT DOCUMENTS 1,291,967 A * 1/1919 McDougal ..... 473/251
1,299,014 A * 4/1919 O'Hara ..... 473/330
1,433,150 A * 10/1922 Reach ..... 473/251
1,503,291 A * 7/1924 Rimmer ..... 473/251
1,511,479 A * 10/1924 Kelly et al. ..... 473/330
1,703,199 A * 2/1929 McClure ..... 473/243
1,756,219 A * 4/1930 Spiker ..... 473/251
2,023,885 A * 12/1935 Hinckley ..... 473/559
2,174,212 A * 9/1939 Newsome ..... 473/251
2,820,638 A * 1/1958 Morrison ..... 473/252
2,954,231 A * 9/1960 MacIntyre ..... 473/251
2,957,696 A * 10/1960 Warpotas ..... 473/251
3,430,963 A * 3/1969 Wozniak et al. ..... 473/251
D221,446 S * 8/1971 Cook ..... D21/739
3,759,527 A * 9/1973 Witherspoon ..... 473/306
3,819,180 A * 6/1974 Murphy ..... 473/313
3,955,819 A * 5/1976 Yokich ..... 473/252
3,989,257 A 11/1976 Barr
4,121,833 A 10/1978 Prueter
4,290,606 A * 9/1981 Maxwell ..... 473/569
4,461,482 A * 7/1984 Bojicic ..... 473/254
4,471,961 A * 9/1984 Masghati et al. ..... 473/330

(Continued)

*Primary Examiner*—Sebastiano Passaniti
(74) *Attorney, Agent, or Firm*—MacMillan, Sobanski & Todd, LLC

(57) ABSTRACT

The invention concerns a training head (20) for a golf training putter (14) and a method of using this training putter (14) to improve ones putting skill for side-swing type putting motion. The training head (20) may include two opposed hitting faces (28, 30), with each hitting face (28, 30) defining a portion of a cylinder about a vertical axis. This cylindrical surface is oriented so the face (28, 30) will strike a golf ball (24) perpendicular to the direction one desires the ball (24) to travel if hit at the central location of this surface (28, 30), but will deflect the ball (24) in a different direction if a location other than the central location of the face (28, 30) strikes the ball (24). This training putter (14) may have symmetrical hitting faces (28, 30) so that left-handed and right-handed golfers can use it.

25 Claims, 5 Drawing Sheets

U.S. PATENT DOCUMENTS 4,776,594 A 10/1988 Rango
5,160,143 A 11/1992 Dwyer
5,160,144 A 11/1992 Maniatis
5,213,332 A 5/1993 Fahy et al.
5,316,304 A * 5/1994 Yost ..... 473/330
5,333,873 A 8/1994 Burke
5,382,019 A 1/1995 Sneed
5,441,268 A 8/1995 Shier
5,460,375 A 10/1995 Hardee
5,476,262 A 12/1995 Bandiero
5,478,078 A 12/1995 Lee
5,792,003 A 8/1998 Gavranovich
5,820,477 A 10/1998 Redkey et al.
5,993,324 A 11/1999 Gammil
6,045,452 A 4/2000 Ahn et al.
6,062,987 A 5/2000 Woodward
6,066,053 A 5/2000 Sehemberger
6,155,933 A 12/2000 Schmitt
6,203,444 B1 3/2001 McRae
6,267,690 B1 7/2001 Salmon
6,340,336 B1 1/2002 Loconte
6,402,638 B1 6/2002 Kelley
6,406,380 B1 6/2002 Jackson
6,409,610 B1 6/2002 Ahn et al.
6,454,664 B1 * 9/2002 Long et al. ..... 473/330
6,458,043 B1 10/2002 McCabe et al.
6,464,596 B1 10/2002 Belding
6,520,865 B1 2/2003 Fioretti
6,524,193 B1 2/2003 Devore
6,558,272 B2 5/2003 Helmstetter et al.
6,572,489 B2 6/2003 Miyamoto et al.
6,579,193 B1 6/2003 McDowell
6,595,869 B2 7/2003 McCabe et al.
6,638,181 B1 10/2003 Norman, III
6,702,688 B2 3/2004 Hale
6,729,966 B1 5/2004 Barelli et al.
6,776,727 B1 8/2004 Engdahl
2003/0008724 A1 1/2003 Griffin
2004/0166950 A1 8/2004 Park
2004/0166952 A1 8/2004 Park
2004/0176176 A1 9/2004 Murtha
2004/0198531 A1 10/2004 Pechter et al.
2004/0204261 A1 10/2004 Port et al.
2004/0219987 A1 11/2004 Scott et al.
2004/0229712 A1 11/2004 Jackson
2004/0242344 A1 12/2004 Williams et al.
2004/0248663 A1 12/2004 Trainello
2007/0087859 A1 * 4/2007 Thorn ..... 473/330

* cited by examiner

TRAINING HEAD FOR GOLF TRAINING PUTTER, AND METHOD OF TRAINING

CROSS REFERENCE TO RELATED APPLICATIONS

This application claims the benefit of U.S. Provisional Application No. 60/679,303, filed May 10, 2005, which is incorporated herein by reference.

BACKGROUND OF THE INVENTION

The present invention relates generally to golf putters, and in particular to a golf putter with a training head and a method of using this golf putter to improve ones putting skills.

Many people enjoy the game of golf. However, for some, their inability to putt accurately causes a great amount of frustration. Many times the golfer believes that the head of the putter is lined up accurately with the ball, yet the ball goes off in an unintended direction and misses the hole. This may be due to the slope of the putting green or due to the fact that the putt was not correctly aimed toward the hole—or it may also be that the golfer struck the ball at the wrong location on the pufter head. This latter problem may be missed by many golfers who do not realize that they are striking the ball at this improper location.

Some golfers, then, may want help with their putting stroke to assure that the proper location of the putter head contacts the ball. And, its is also desirable to let the golfer know when and how far off they are from hitting at the proper location. Preferably, such training assistance can be provided with minimal cost, is easy to use, and also allows one to practice his natural putting swing with a training putter having a similar size, weight, and balance as a conventional putter.

While most of those who play golf are right-handed, there are also left-handed golfers who require a different set of clubs. Thus, it would be desirable to have a training tool that can be used by both right-handed and left-handed individuals.

BRIEF SUMMARY OF THE INVENTION

According to an embodiment, there is provided a golf training putter for hitting a golf ball with a side-swing motion including a shaft, and a training head, mounted on the shaft, including a first hitting face that has a convex cylindrical curvature relative to a vertical axis and has a central location that will cause the golf ball to travel along a desired path when hit thereon and curvature sufficient to cause the golf ball to be misdirected if hit at a location on the first hitting face other than the central location.

According to an embodiment, there is provided a training head for a golf putter for hitting a golf ball with a side-swing motion. The training head may include a first hitting face that has a first convex curvature relative to a vertical axis and has a first central location that is a first desired contact location for the golf ball, the first central location being where the first convex curvature switches from a positive slope to a negative slope; and a second hitting face, in opposed relation to the first hitting face, having a second convex curvature relative to the vertical axis and having a second central location that is a second desired contact location for the golf ball, the second central location being where the second convex curvature switches form a positive slope to a negative slope.

According to an embodiment, there is provided a method of training a golfer to properly putt a golf ball with a side-swing motion using a golf training putter having a training head, the method comprising the steps of: (a) aligning a central location of one of a first convex hitting surface and an opposed second convex hitting surface of the training head with the golf ball; (b) orienting a locating line, extending normal to the central location, in a desired direction of travel of the golf ball; (c) making contact with the golf ball by swinging the golf training putter in a side-swinging motion; (d) observing an actual direction of travel of the golf ball; and (e) repeating steps (a) and (b) if the actual direction of travel is not the same as the desired direction of travel of the golf ball.

The golf putter training head in accordance with an embodiment advantageously provides a method for assisting a golfer to improve his putting game by exaggerating the misdirected path along which the golf ball will travel if not aligned properly with the head of the putter when hitting the ball with a side-swing motion.

An advantage of an embodiment is that the training putter, preferably having two opposed and symmetrical hitting surfaces on its training head, can be used by both left handed and right handed golfers to practice putting. The symmetry may also improve the ease of manufacturing of the training head, and the balance of the training head.

An advantage of an embodiment is that the putter training head, while being wider than a conventional putter head, may have hollowed-out areas to better match the weight and feel of a conventional putter head.

An advantage of an embodiment is that the golf training putter is easy to use and does not require any set up or special equipment.

An advantage of an embodiment is that the training head of the training putter may include orientation lines on its top to provide guidance for the golfer to ensure that the ball is hit at the proper location and orientation.

DETAILED DESCRIPTION

Figure 1:
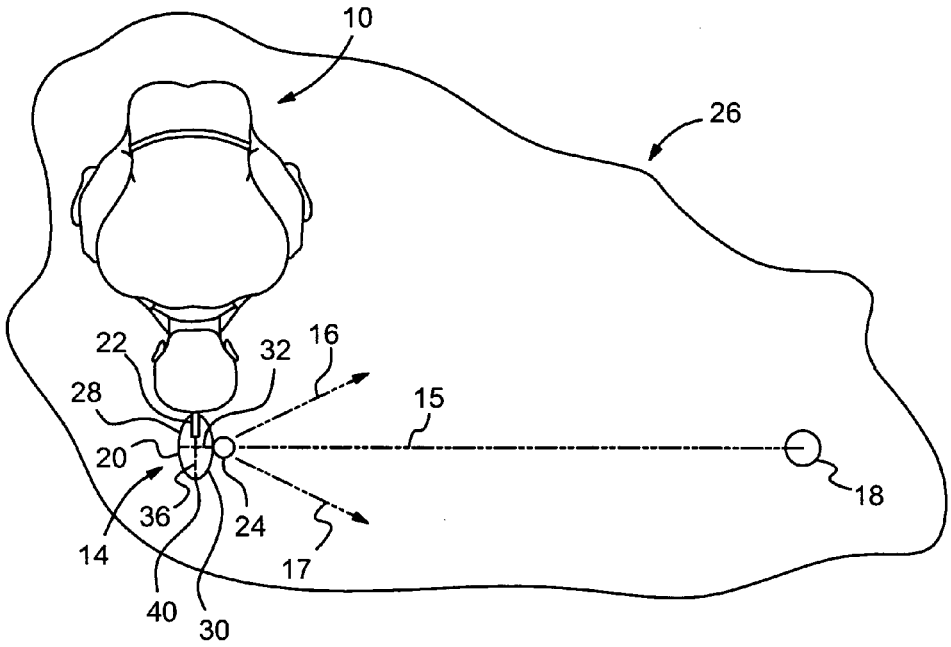
FIG. 1 is a schematic view of a golfer on a putting green employing a training putter with a training head.

FIG. 1 shows a golfer 10 on the putting green 26 holding a shaft 22 of a training putter 14. The training putter 14 includes a training head 20 aligned with a golf ball 24. The golf ball 24 is conventional and the shaft 22 of the training putter 14 can be conventional, if so desired. But the training head 20 is specially shaped to provide a teaching/training aid for one who wishes to improve his putting game, (and who uses a putter with a side-swing putting motion rather than a between the legs type of motion to putt). If the ball 24 is hit properly, it will travel along path 15 toward the hole 18. A locating line 32 extending between the hitting faces 28, 30 is provided indicating where on the hitting face (in this case, face 30) the golfer 10 needs to make contact with the ball 24. An orientation line 36 extends from a toe 40 of the training head 20 to a heel (not shown in this view) and visually assists the golfer 10 in assuring that the training putter 14 is oriented properly.

One will note that—given the curvature on the hitting face 28 or 30 of the training head 20 (discussed in more detail below)—unless contact is made with the ball 24 at the central location of the particular hitting face (as indicated by the locating line 32), and at the proper orientation (as can be determined from the orientation line 36), the ball 24 will be misdirected away from the hole 18. This misdirection may be, for example, along one of the paths 16 or 17. The curvature of the hitting face increases the misdirection of the ball 24 the farther one hits the ball 24 from the correct location on the hitting face. Thus, the farther the ball 24 is hit from this sweet spot, the greater the direction of travel of the ball will be off target.

Accordingly, to employ the training putter 14 for training or practice, the golfer 10 will hold the shaft 22 of the training putter 14 with the locating line 32 extending in the direction the golfer 10 wishes the ball to travel when he makes contact. The golfer 10 will stand with his side facing in the general direction of the hole 18, (rather than his front, which would be the case with a between the legs type of putter and putting motion). The orientation line 36, being perpendicular to the locating line 32, will provide a visual aid to help the golfer 10 make sure the training head 20 is oriented properly. The golfer 10 will align the locating line 32 with the ball since the locating line 32 is a visual indication of the proper central contact location (discussed more below) for the training head 20 with the ball 24.

The golfer 10 will then swing the training putter 14 in a side-swing type of motion, making contact with the ball 24, and watch to see the trajectory of the ball 24. If the ball 24 rolls straight toward the hole 18, then the golfer 10 has made contact at the proper location on the training head 20. If the trajectory is off, then the golfer 10 will note in which direction and by how large of an angle. If the orientation was proper, and the ball 24 traveled in the general direction of trajectory 16, then the golfer 10 knows that the training head 20 of the training putter 14 hit the ball 24 toward the heel end rather than at the desired central location. If the ball 24 traveled in the general direction of trajectory 17, then the golfer 10 knows that the training head 20 of the training putter 14 hit the ball 24 toward the toe end 40 rather than at the desired central location. And, the golfer 10 knows that, the greater the angle between the actual trajectory versus the desired trajectory of the ball 24, the farther from the desired central location the ball 24 was hit. The golfer 10 can then take this information into account and make adjustments to his side-swing alignment and motion in order to improve his putting abilities.

Figure 2:
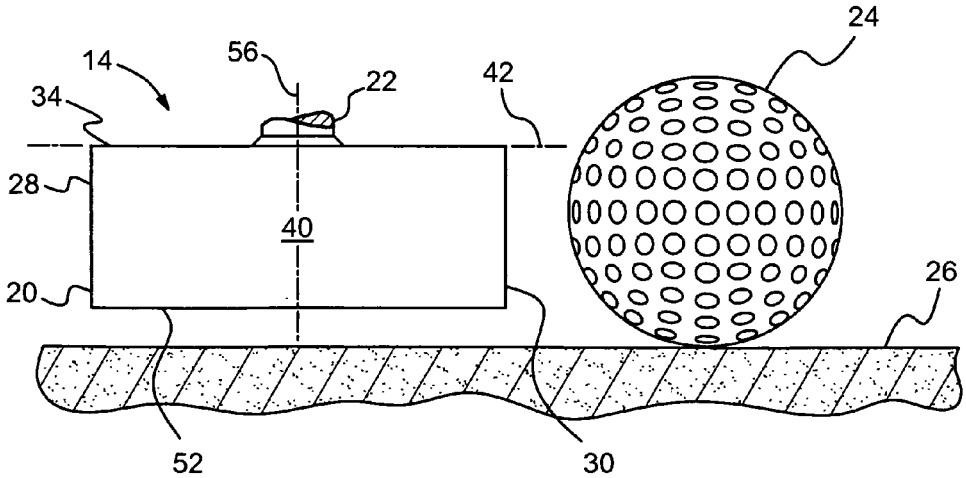
FIG. 2 is a side end view of a golf training putter, prior to striking a golf ball on a putting green, according to a first embodiment.
Figure 3:
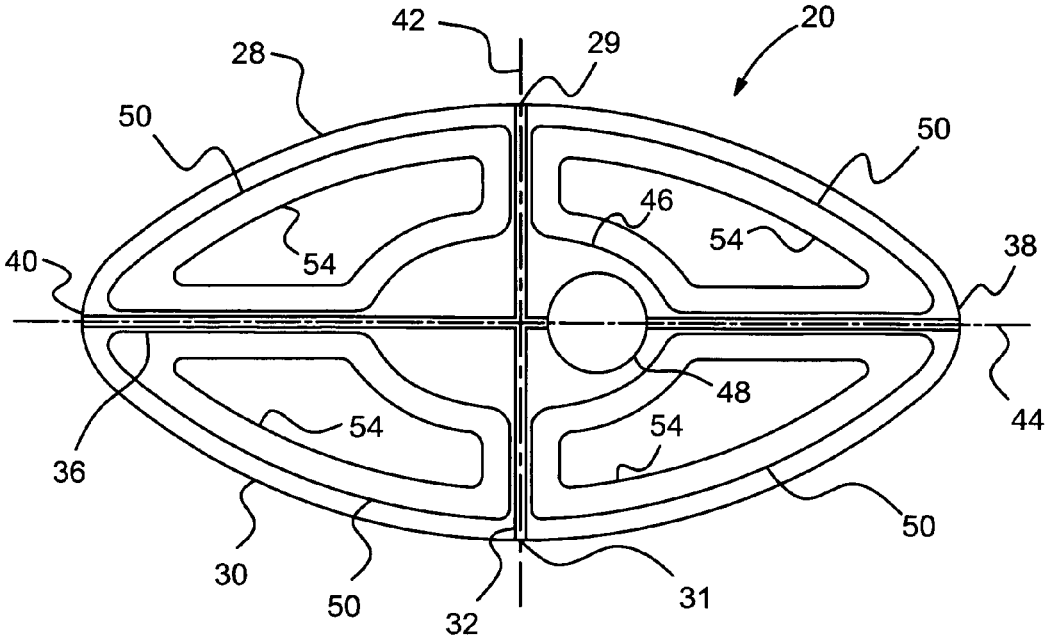
FIG. 3 is a top plan view of a training head in accordance with the first embodiment.
Figure 4:
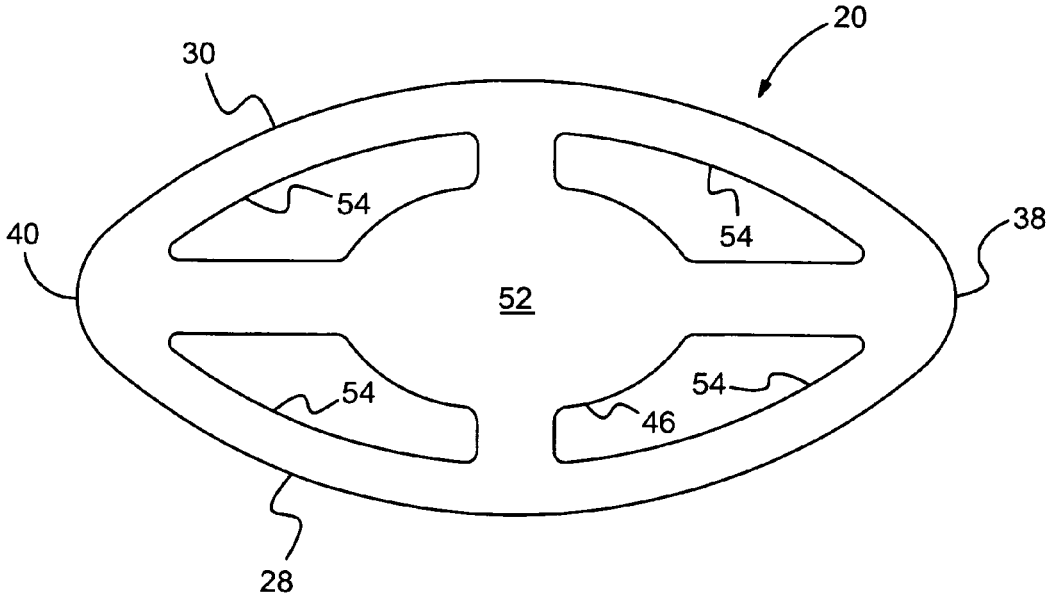
FIG. 4 is a bottom plan view of the training head in accordance with the first embodiment.
Figure 5:
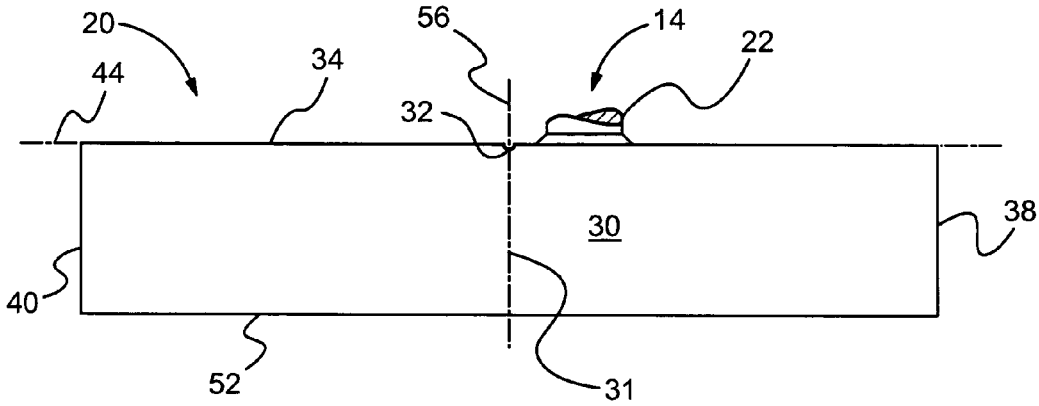
FIG. 5 is a side view of the training head, looking at a hitting face, and a portion of a putter shaft, in accordance with the first embodiment.

FIGS. 2-5 illustrate a first embodiment. FIG. 2 shows a portion of the shaft 22 and a toe-end view of the training head 20, which is aligned with the golf ball 24 on the putting green 26. FIGS. 2-5 show the training head 20 in more detail. The training head 20 of the training putter 14 of the first embodiment is preferably symmetrical, with the curved left-hand hitting face 28 opposite and symmetrical with the curved right hand hitting face 30. The training head 20 has a heel 38, which faces toward the golfer, and the toe 40, which faces away from the golfer. A bottom face 52 of the training head 20 faces the putting green 26, while a top face 34 faces upwards. The training head 20 may be made of aluminum, titanium, plastic, graphite, wood, composite or other suitable materials.

The locating line 32 extends along the top 34 of the training head 20 from the right-hand hitting face 30 to the left-hand hitting face 28, centered about a central lateral axis 42, indicating where each hitting face should make contact with the ball 24 (i.e., where the sweet spot is). The locating line 32 may be a groove extending partially or all of the way across the top 34 of the training head 20, and may run, for example, from the central location 29 of the left-hand hitting face 28 to central location 31 of the right-hand hitting face 30.

The orientation line 36 may extend along the top 34 of the training head 20 from the heel 38 to the toe 40, centered about a central longitudinal axis 44, helping the golfer to make sure the training head 20 is oriented properly. The orientation line 36 may be a marking extending across the top 34 of the training head 20 that is perpendicular to the locating line 32. As an alternative, the locating line 32 may be markings on the top surface 34 that are painted-on or decals that are adhered thereto, and/or the orientation line 36 may be a groove in the top surface 34.

The training head 20 also includes a central mounting pad 46 with a shaft bore 48 therein for receiving and retaining the shaft 22. The training head 20 may be secured to the shaft in a conventional manner or by any other suitable means desired. The shaft bore 48 is preferably centered between the hitting faces 28, 30 to provide a balanced club for both right-handed and left-handed users making a side-swing motion. The shaft 22 extends upward from the top surface 34 and outward over the heel 38 of the training head 20 so the golfer can make the side-swing motion (rather than a between the legs motion of a putter with a shaft extending out of a back face opposite a hitting face of that type of club).

The training head 20 is preferably hollowed-out between the central mounting pad 46 and the hitting faces 28, 30 in order to minimize the overall weight of the training head 20. Thus, four lightening holes 50 extend from the top 34 through the bottom 52. Strengthening ribs 54 may extend around each lightening hole 50 near the bottom 52 in order to provide greater structural integrity to the training head 20.

Each hitting face 28, 30 has a shape that preferably defines a portion of a circular cylinder relative to a vertical axis 56, with this shape extending across almost all or all of its face. Each partial cylindrical shape is convex and oriented so that each face will strike the golf ball 24 perpendicular to the direction one desires the ball 24 to travel if hit at the central location 29, 31 of that face 28, 30, respectively, but will deflect the ball 24 in a different direction if hit at a location other than its central location 29, 31. The curvature may be, for example, a circular curvature with a radius that is about 12.7 centimeters (cm) (5 inches) or less, preferably a circular radius of about 7.6-10.2 cm (3-4 inches), and more preferably a circular radius of about 8.9 cm (3.5 inches). Of course, the smaller the radius, the greater the misdirection of the ball when the golfer misses the particular central location 29, 31—so too large of a radius will defeat the purpose of providing a training tool for a golfer.

While the curvature of each face 28, 30 is preferably a convex circular cylindrical shape, alternatively, each may be somewhat of a convex elliptical or oval cylindrical shape. These shapes are satisfactory so long as the curvature is sufficient to provide a noticeable change in direction when hit improperly with a side-swing motion and to increase this misdirection the farther from the central location that the ball is hit in order to fulfill its intended purpose of being a training tool. Moreover, as an alternative, each hitting face 28, 30 may have a very small flat surface on either side of the central location 29, 31, respectively, rather than being a constant curve along the entire face. But this should be a very small flat—for example, about 0.25 cm (1/10 inch) or less. Otherwise, the training effect may be diminished since, in general, the preference is, the farther from the central location the ball is hit, the greater the angle of misdirection.

The central location 29, 31 is preferably centered between the heel 38 and toe 40 of the head 20, but may be slightly off-center if so desired—thus, the central location 29, 31, as used herein, is the location on the particular hitting face 28, 30 where the curvature switches from a positive slope to a negative slope. The location for switching from a positive slope to a negative slope, as used herein, means the location where the hitting face will be parallel to the central longitudinal axis 44. The central lateral axis 42 will be centered on and perpendicular to this location.

The training head 20 may have general overall dimensions, for example, of about 11.4-12.7 cm (4.5-5.0 inches) heel 38 to toe 40, 5.7-7.0 cm (2.25-2.75 inches) central location 29 to central location 31, and about 1.9-3.8 cm (0.75-1.5 inches) top 34 to bottom 52. Of course, the training head 20 may have different dimensions, if the golfer so desires. The general intent is to provide the golfer with a training head 20 that will have a feel, when swung in a side-swing motion, similar to that of an actual golf putter.

Figure 6:
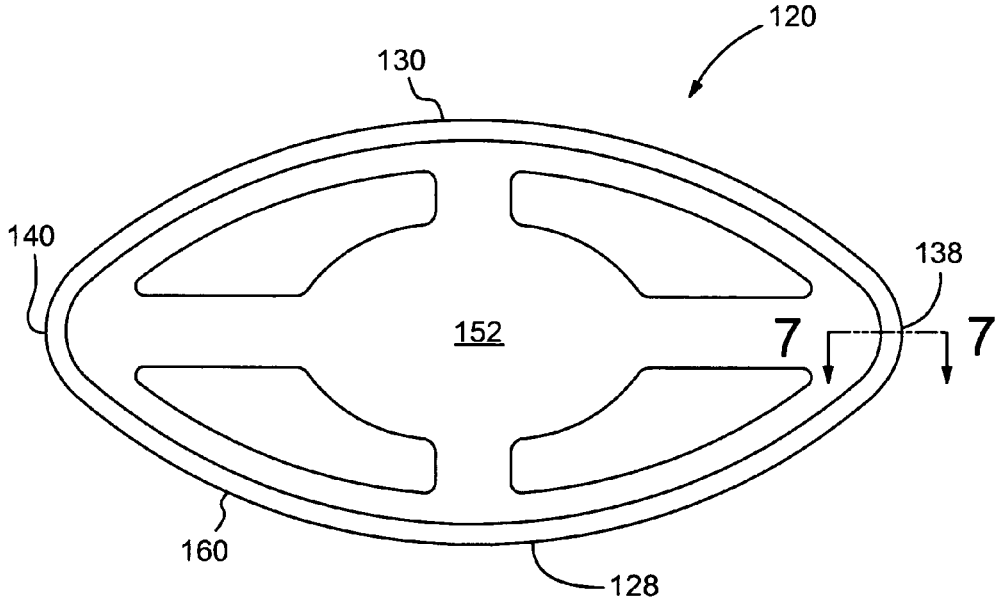
FIG. 6 is a bottom plan view, similar to FIG. 4, but illustrating a second embodiment.
Figure 7:
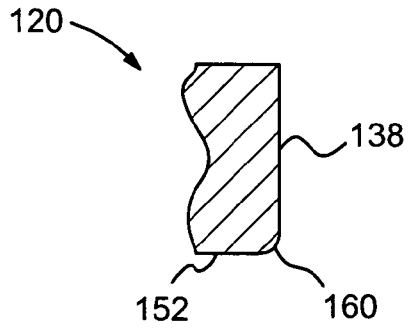
FIG. 7 is a section cut taken along line 7-7 in FIG. 6.

FIGS. 6 and 7 show a second embodiment. This embodiment is similar to the first, so similar elements will be similarly designated, but employing 100-series numbers. In this embodiment, the training head 120 is similar to the first embodiment, except there is a rounded-off corner 160 around the perimeter, between the bottom surface 152 and side surfaces 128, 130, 138, and 140 of the head 120. This rounded corner 160 may be a chamfered edge instead, if so desired.

Figure 8:
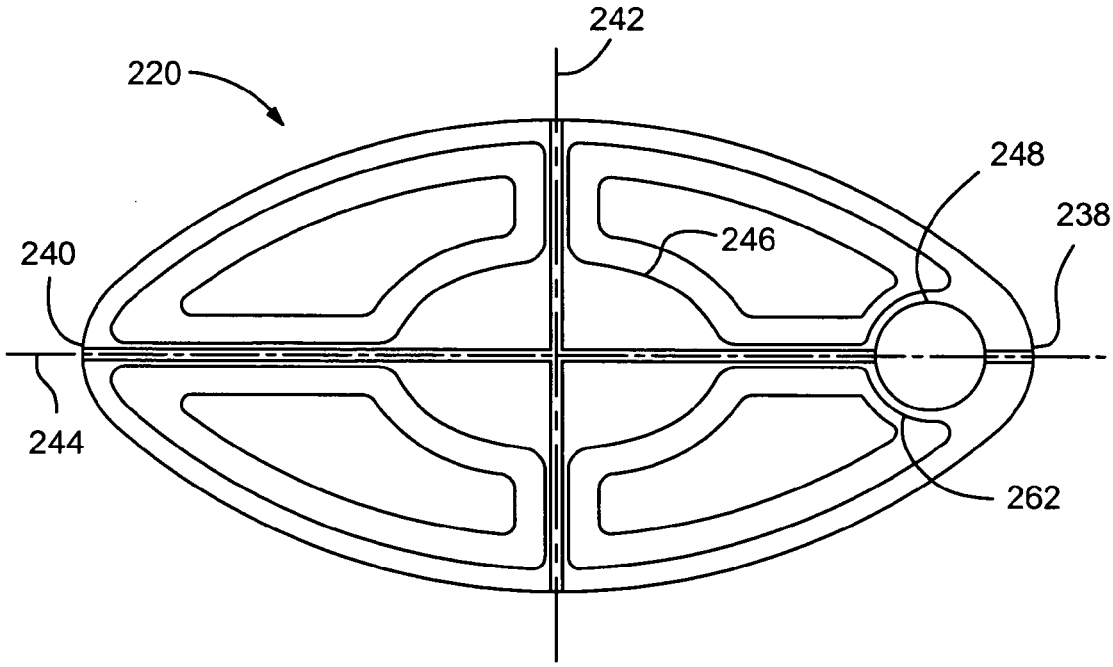
FIG. 8 is a top plan view, similar to FIG. 3, but illustrating a third embodiment.

FIG. 8 shows a third embodiment. This embodiment is similar to the first, so similar elements will be similarly designated, but employing 200-series numbers. In this embodiment, the training head 220 is similar to the first embodiment, except the location for mounting the shaft (shaft not shown in this embodiment) is now near the heel 238 of the training head 220. A mounting pad 262 and shaft bore 248 are added near the heel 238 to accommodate this new mounting location. The shaft bore 248 is still preferably centered about the central longitudinal axis 244 and extends upward from the top of the training head 220, but is farther from the central lateral axis 242. As an alternative, another pad (not shown)—similar to the mounting pad 262—may be added near the toe 240 in order to assure that the training head 220 is more evenly balanced heel-to-toe, or to provide more weight at one end or the other, as is desired, to obtain a preferred balance of the head 220 for a side-swing motion. This may include having a shaft bore for the shaft at both ends—making the head symmetrical—for ease of manufacturing. Moreover, as another alternative, the center pad 246 may be reduced or eliminated, if so desired, which may be combined with the previously mentioned alternative of adding a pad near the toe 240.

Figure 9:
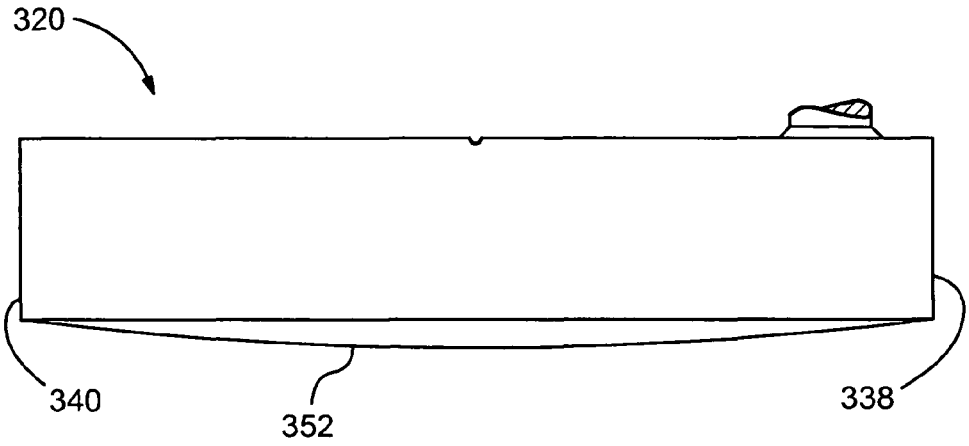
FIG. 9 is a side view, similar to FIG. 5, but illustrating a fourth embodiment.

FIG. 9 shows a fourth embodiment. This embodiment is similar to the first and third embodiments, so similar elements will be similarly designated, but employing 300-series numbers. The training head 320 is similar to the third embodiment, except the bottom surface 352 now has a small curvature in one—or preferably both—directions rather than a perfectly flat bottom surface. Generally this curvature is small, extending about 0.5 cm (3/16 inch) or less from the bottom of the heel and toe surfaces 338, 340 to the lowest point near the center of the bottom surface 352 of the training head 320.

Figure 10:
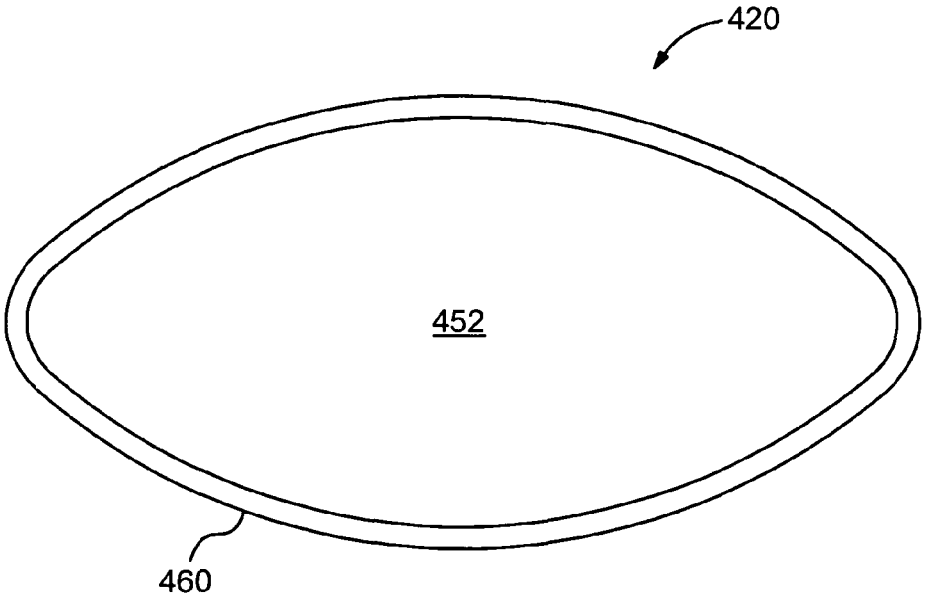
FIG. 10 is a bottom plan view, similar to FIG. 4, but illustrating a fifth embodiment.

FIG. 10 shows a fifth embodiment. This embodiment is similar to the first and second embodiments, so similar elements will be similarly designated, but employing 400-series numbers. The training head 420 is similar to the second embodiment with a rounded off corner 460, except that now the bottom surface 452 of the training head 420 is solid rather than having holes extending therethrough.

The features disclosed in all of the various embodiments discussed herein may be combined in various ways, as desired, to obtain one's preferred training head for the training putter, while still remaining within the scope of the present invention. Accordingly, while certain embodiments of the present invention have been described in detail, those familiar with the art to which this invention relates will recognize various alternative designs and embodiments for practicing the invention as defined by the following claims.

What is claimed is:

1. A golf training putter for hitting a golf ball with a side-swing motion comprising:

a shaft; and a training head, mounted on the shaft, including a first hitting face that has a convex cylindrical curvature relative to a vertical axis and has a central location that will cause the golf ball to travel along a desired path when hit thereon and curvature sufficient to cause the golf ball to be misdirected if hit at a location on the first hitting face other than the central location; and a second hitting face, in opposed relation to the first hitting face, that has a convex curvature relative to the vertical axis and has a second central location that will cause the golf ball to travel along a desired path when hit thereon and curvature sufficient to cause the golf ball to be misdirected if hit at a location on this second hitting face other than the central location.

2. The golf training putter of claim 1 wherein the second hitting face has a convex cylindrical curvature relative to the vertical axis.

3. The golf training putter of claim 2 wherein the training head includes a top surface having a locating line extending between the central location on the first hitting face and the second central location on the second hitting face.

4. The golf training putter of claim 1 wherein the training head includes a top surface having a locating line extending from and oriented normal to the central location on the first hitting face.

5. The golf training putter of claim 4 wherein the locating line is a groove recessed in the top surface.

6. The golf training putter of claim 4 wherein the training head includes a heel, located adjacent to the first hitting face, and a toe adjacent to the first hitting face and in opposed relation to the heel, and the top surface has an orientation line extending from the heel to the toe and oriented normal to the locating line.

7. The golf training putter of claim 1 wherein the training head includes a heel, located adjacent to the first hitting face, and a toe adjacent to the first hitting face and in opposed relation to the heel, and a top surface that has an orientation line extending from the heel to the toe.

8. The golf training putter of claim 1 wherein the training head includes a central mounting pad with a shaft bore extending therein, and the shaft is received and secured in the shaft bore.

9. The golf training putter of claim 1 wherein the training head has a heel and includes a mounting pad adjacent to the heel, the heel having a shaft bore extending therein, and the shaft received and secured in the shaft bore.

10. The golf training putter of claim 1 wherein the training head has a closed bottom surface and an opposed top surface, the top surface including a plurality of lightening holes therethrough extending partially through the training head toward the bottom surface.

11. The golf training putter of claim 1 wherein the training head has a bottom surface and an opposed top surface, and a plurality of lightening holes extending through the training head from the top surface to the bottom surface.

12. The golf training putter of claim 1 wherein the training head includes a bottom surface adjacent to the first hitting face and forming a corner therebetween, the corner having a shape that is one of rounded-off and chamfered.

13. The golf training putter of claim 1 wherein the training head includes a bottom surface that has a curved convex shape.

14. The golf training putter of claim 1 wherein the convex cylindrical curvature of the first hitting face is a circular cylinder shape.

15. The golf training putter of claim 14 wherein the circular cylinder shape has a radius of less than about 12.7 centimeters.

16. The golf training putter of claim 14 wherein the circular cylinder shape has a radius of about 8.9 centimeters.

17. The golf training putter of claim 1 wherein the convex cylindrical curvature of the first hitting face is one of an elliptical cylinder and an oval cylinder.

18. A training head for a golf training putter for hitting a golf ball with a side-swing motion, the training head comprising:

a first hitting face that has a first convex cylindrical curvature relative to a vertical axis and has a first central location that is a first desired contact location for the golf ball, the first central location being where the first convex curvature switches from a positive slope to a negative slope; and a second hitting face, in opposed relation to the first hitting face, having a second convex curvature relative to the vertical axis and having a second central location that is a second desired contact location for the golf ball, the second central location being where the second convex curvature switches form a positive slope to a negative slope.

19. The training head of claim 18 wherein the first convex curvature is a circular cylinder shape and the second convex curvature is a circular cylinder shape.

20. The training head of claim 18 including a top surface extending between the first hitting face and the second hitting face, with the top surface having a locating line extending between the first central location and the second central location.

21. The training head of claim 18 including a plurality of lightening holes located between the first hitting face and the second hitting face.

22. The training head of claim 18 including a heel located adjacent to the first and second hitting faces, and a toe adjacent to the first and second hitting faces and in opposed relation to the heel, and a top surface that has an orientation line extending from the heel to the toe.

23. The training head of claim 18 including a mounting pad having a shaft bore adapted for mounting a shaft, the shaft bore being centered between the first hitting face and the second hitting face.

24. A method of training a golfer to properly putt a golf ball with a side-swing motion using a golf training putter having a training head, the method comprising the steps of:

(a) aligning a central location of one of a first convex cylindrical hitting surface and an opposed second convex cylindrical hitting surface of the training head with the golf ball;

(b) orienting a locating line, extending normal to the central location, in a desired direction of travel of the golf ball;

(c) making contact with the golf ball by swinging the golf training putter in a side-swinging motion;

(d) observing an actual direction of travel of the golf ball; and (e) repeating steps (a) and (b) if the actual direction of travel is not the same as the desired direction of travel of the golf ball.

25. The method of claim 24 including a step of gripping a shaft extending from a shaft bore of the training head, wherein the shaft bore is centered between the first and second convex cylindrical hitting surfaces.

* * * * *